US006968643B2

(12) United States Patent
Woodbury

(10) Patent No.: US 6,968,643 B2
(45) Date of Patent: Nov. 29, 2005

(54) DUAL-ZERO SIGHT FOR A FIREARM

(76) Inventor: Martin Woodbury, 912 8th St., Nampa, ID (US) 83651

( * ) Notice: Subject to any disclaimer, the term of this patent is extended or adjusted under 35 U.S.C. 154(b) by 0 days.

(21) Appl. No.: 10/772,154

(22) Filed: Feb. 3, 2004

(65) Prior Publication Data

US 2004/0226213 A1 Nov. 18, 2004

Related U.S. Application Data

(60) Provisional application No. 60/445,173, filed on Feb. 3, 2003.

(51) Int. Cl.[7] ..... F42G 1/06; F42G 1/10
(52) U.S. Cl. ..... 42/137; 42/140; 42/138
(58) Field of Search ..... 42/135, 138, 111, 42/136, 137, 140, 141, 148

(56) References Cited

U.S. PATENT DOCUMENTS

| | | | | | |
|---|---|---|---|---|---|
| RE14,009 | E | | 11/1915 | Warner | |
| 1,202,416 | A | | 10/1916 | Packard, Jr. | |
| 1,206,060 | A | | 11/1916 | Warner | |
| 1,216,783 | A | * | 2/1917 | Dietz | 42/136 |
| 1,275,147 | A | | 8/1918 | Frensdorf | |
| 1,307,441 | A | * | 6/1919 | Frensdorf | 42/136 |
| 1,715,203 | A | * | 5/1929 | Loomis | 42/136 |
| 1,908,019 | A | * | 5/1933 | Howard | 42/139 |
| 2,032,648 | A | * | 3/1936 | Bliss | 42/136 |
| 2,079,266 | A | | 5/1937 | Vaver | 33/47 |
| 2,345,553 | A | | 4/1944 | Brown et al. | 33/58 |
| 2,494,163 | A | | 1/1950 | Davis | 33/56 |
| 2,781,583 | A | | 2/1957 | Grimble | 33/47 |
| 2,963,789 | A | | 12/1960 | Wilhelm | 33/56 |
| 3,193,932 | A | | 7/1965 | Johnson | 33/47 |

(Continued)

OTHER PUBLICATIONS

Description and Nomenclature of the Model 1898 Front and Rear Sights, for the U.S. Magazine Rifle, pp. 58 and 59, and photos of the sights, dated 1898 and 1899.

(Continued)

*Primary Examiner*—Michael J. Carone
*Assistant Examiner*—Bret Hayes
(74) *Attorney, Agent, or Firm*—Pedersen & Co., PLLC; Ken J. Pedersen; Barbara S. Pedersen

(57) ABSTRACT

A sighting system for a firearm includes a rear sight unit having a plurality of separate sight elements adaptable for "zeroing" the same gun with different ammunition. The multiple-zero sight unit comprises windage and elevation adjustments for each sight element, so that multiple ammunition types having different trajectories may be fired accurately from a single firearm after zeroing-in one of the plurality of sight elements for each of the different ammunition types. Preferably, the separate sight elements may be connected to each other or to a common pivot arm or movable bracket so that moving one sight element into the sight path automatically removes the other from the line of vision. Elevation adjustments may be done in various ways, for example, by sliding sight elements out along an arm or bracket, or by changing an angle of the arm or bracket relative to the firearm. The preferred sighting system also includes an adjustable front sight unit, which can be raised or lowered in elevation, by sliding a fin or blade up or down or by adding or removing an extension member. Adding the extension member may provide a gross adjustment of the front end of the firearm by significantly lowering the barrel position for a given line of sight between the user's eye, the selected rear sight, and the front sight.

19 Claims, 10 Drawing Sheets

U.S. PATENT DOCUMENTS

| | | | | | |
|---|---|---|---|---|---|
| 3,495,339 | A | | 2/1970 | Elliason | 33/56 |
| 3,975,851 | A | | 8/1976 | Benford | 42/1 S |
| 4,008,536 | A | | 2/1977 | Adams | 42/1 S |
| 4,208,821 | A | | 6/1980 | Power | 41/1 S |
| 4,223,446 | A | | 9/1980 | Villa | 33/261 |
| 4,388,772 | A | | 6/1983 | Maes | 42/1 S |
| 4,597,211 | A | * | 7/1986 | Miles | 42/112 |
| 4,628,611 | A | | 12/1986 | Ruffino | 33/254 |
| 4,837,937 | A | | 6/1989 | Hasselbusch | 33/257 |
| 4,976,038 | A | | 12/1990 | Nattrass | 33/233 |
| 4,977,678 | A | * | 12/1990 | Sears | 33/265 |
| 5,063,677 | A | * | 11/1991 | Millett | 42/137 |
| 5,327,654 | A | | 7/1994 | Parker | 33/258 |
| 5,519,941 | A | | 5/1996 | Yusko | 33/252 |
| 5,533,292 | A | * | 7/1996 | Swan | 42/123 |
| 5,918,374 | A | | 7/1999 | Campbell et al. | 33/233 |

OTHER PUBLICATIONS

Marlin Firearms, A History Of The Guns And The Company That Made Them, by Lt. Col. William S. Brophy, USAR, Ret., 1989, pp. 633-653.

* cited by examiner

DUAL-ZERO SIGHT FOR A FIREARM

This application claims priority of Provisional Application Ser. No. 60/445,173, filed Feb. 3, 2003, entitled "Dual-Zero Sight", which is hereby incorporated by reference.

BACKGROUND OF THE INVENTION

1. Field of the Invention

This invention relates, in general, to gun sights for shotguns and other firearms. More specifically, this invention relates to a single, adjustable sighting device that may be used for sighting-in a plurality of ammunition, for example, long range and close range ammunition.

2. Related Art

For hunters, sportsmen, law enforcement personnel and other gun users, it is difficult or impractical to carry several firearms in the field. However, the type of ammunition used is often changed in response to the demands of different situations, for example, the change from large to small game. Consequently, a number of smoothbore firearms, and their ammunition, have been modified to improve their effectiveness over a range of shooting tasks. One such modification permits the firing of a plurality of ammunition from the same gun for example, single-slug and buckshot loads. Typically, single-slug loads are used for long range targets, and buckshot loads are used for short range targets. Due to the substantially different ballistic characteristics of these loads, "zeroing-in" or "sighting-in" targets with these different loads using a single sight can be problematic.

Several attempts have been made to provide a shotgun sight that is capable of accurately sighting-in shots taken with both slug and buckshot loads. For example, U.S. Pat. No. 2,781,583 (Grimble) describes a gun sight attachment, which converts the typical bead sight of a shotgun to a blade sight, such as may be found on a rifle. The blade sight attachment slides over the tip of the barrel and surrounds the bead sight and barrel tip.

U.S. Pat. No. 3,193,932 (Johnson) discloses a detachable front sight that may be used to assist in the sighting of a gun when firing different ammunition. This sight extends vertically above the gun barrel at its tip and replaces the normal bead sight. Screws are threaded through the generally flat upper surface of the sight and into the barrel to hold it in place.

U.S. Pat. No. 3,975,851 (Benford) teaches another detachable sight for use with shotguns that helps users align slug-load shots with a target. This sight comprises a rear-mounted apparatus featuring a V-shaped notch through which the front sight, typically a bead sight, may be viewed. In one embodiment of this design, adjustments for windage and elevation may be made.

Some firearms of the late 1800's and early 1900's included a rear sight device featuring range adjustability for a single ammunition. A Model 1898 U.S. Magazine Rifle includes a sighting device having an elongated "leaf" with indicia to provide a calibration reference for range. The eye piece of this sighting device is raised or lowered to achieve increased shooting accuracy at a desired range, by means of a slide that is moved along the leaf to the appropriate indicia. Still, this 1898 sighting device has a single rear sight, that is, a single "zero." This 1898 device has one elevation adjustment and one windage adjustment. It is adapted for use with a single firearm shooting a single ammunition over a range reportedly from about 200–2000 yards. Such a sight is understandable in view of the state of the art in such firearms in that era, wherein the military firearm and ammunition may have produced a trajectory that required substantial adjustments in aiming, especially in elevation, depending on distance of the target from the user of the firearm.

Another firearm of the late 1800's included a rear sighting device featuring range adjustability for a single ammunition. A Model 1899 military rifle includes a rear sighting device with a pivotal arm. The pivotal arm carries a single member that has two outer surfaces that may each be used as a sight. Pivoting the arm serves to place one or the other of the outer surfaces in a position for use as the rear sight. The 1899 sighting device does not have two separate sighting members and does not have separate elevation adjustment for a plurality of sights and does not have separate windage adjustment for a plurality of sights. Again, such a sight is understandable in view of the state of the art in such firearms in that era, for making substantial adjustments in elevation.

Still, there remains a need for a shotgun sight that may be used to accurately sight-in shots with various ammunition, such as slugs or buckshot, and which does not require significant or difficult adjustments to the firearm in the field to switch sights for different ammunition.

SUMMARY OF THE INVENTION

The invention comprises a sighting device for a firearm that has a plurality of separate sights adaptable for "zeroing" the same gun with different ammunition. This multiple-zero sighting system comprises separate windage and elevation adjustments for each sight, so that ammunition having different trajectories may be fired accurately from a single firearm. Preferably, the separate sights may be linked such that moving one component into the sight path automatically removes the other from the line of vision. The plurality of sights may be simply interchanged by rotating, flipping, or sliding the unnecessary element out of the sight path. The plurality of sights may be mounted to an arm that pivots between one or more raised positions and one or more lowered positions, which pivoting may serve to select the operable sight and/or to adjust elevation of that sight.

The invention may comprise using the multiple-zero sighting device as the rear sight on the firearm, preferably in combination with an adjustable front sight. The front sight preferably comprises a blade mounted at the distal end of the gun barrel generally on top of a bead sight. The height of the blade may be adjustable by raising or lowering the blade or by removing it altogether.

Windage adjustment for the multiple-zero sighting device may be accomplished by moving the pivot arm transversely relative to the longitudinal axis of the firearm and/or may be accomplished by moving the sights transversely relative to the pivot arm. Elevation adjustment may be accomplished by pivoting the pivot arm to varying angles relative to the firearm and/or by moving the sights longitudinally on the pivot arm. Preferably, these sight-alignment calibrations are performed once, prior to entering the field, thereby eliminating the need for complex in-the-field adjustments when switching between ammunition types and rear sight components.

In a preferred embodiment of the multiple-zero sighting device, a first sight is located on a rear side of the pivot arm and a second sight is located on a front side of the pivot arm. For an ammunition or a range that requires a higher elevation adjustment, the pivot arm may be swung to a raised position and the sight on the rear side of the pivot arm is used. Once the pivot arm is in the raised position, elevation of this sight is further adjusted by sliding the sight up and down the pivot arm. Windage adjustment for this sight is done by moving the entire pivot arm transversely in relation to the firearm. For an ammunition or range that requires a lower elevation adjustment, the pivot arm may be swung to a lowered position, which moves a sight on the front side of the pivot arm into operable position. When the pivot arm is in the lowered position, elevation of this sight is adjusted by controlling the acute angle between the pivot arm and the firearm. Windage adjustment for this sight is done by moving the sight transversely relative to the pivot arm.

In a less preferred rear sight embodiment, the two independently adjustable sighting components are a hollow ghost ring and a V-shaped notch. The rear sighting components are generally used in combination with the front sight to align a shot. Typically, the hollow ghost ring is used to align shots taken with buckshot and the V-shaped notch is used for slug loads.

The plurality of sights may be simply interchanged by rotating, flipping, or sliding the unnecessary element out of the sight path, for example, in this embodiment, the ghost ring and V-shaped notch are arranged approximately perpendicular to one another upon an "L" shaped frame. The ghost ring may be mounted to the stem of the "L" and the V-shaped notch to the base of the "L", or vice versa. The "L" shaped frame preferably pivots about its elbow such that either the stem or base, and the corresponding sighting element, is extending vertically from the pivot point and positioned within the sight path. This way, the switch between rear sight components is made by pivoting one sighting element out of the sight path and the other into the path. Preferably, each of the rear sight components, ghost ring and V-shaped notch, include separate adjustments for windage and elevation.

DESCRIPTION OF THE PREFERRED EMBODIMENTS

Referring to FIGS. 1–6, there are shown some, but not the only, embodiments of a front and rear sight system for a firearm, wherein the rear sight features a pivotal L-shaped frame having two separate sights. One sight is located on each arm of the L-shaped frame. The sights are flipped into operable position by pivoting the L-shaped frame. Each sight has separate windage and elevation controls.

Referring to FIGS. 7–17, there is shown one, but not the only, embodiment of a rear sight unit, wherein the rear sight features two sights on a single pivotal arm. Preferably, the two sights are located on opposites sides of the pivot arm. The sight on the front side of the pivot arm is used when the arm is pivoted to the upright position. The sight on the rear side of the pivot arm is used when the arm is pivoted down toward the firearm.

FIGS. 1–6

Referring to FIGS. 1–6, a lesser preferred, but not the only, embodiment of an adjustable sighting device for buckshot and slug ammunition in a non-rifled shotgun is presented. The sighting device finds application to a variety of shooting situations. However, the adjustable sight may be particularly useful in situations where a diverse range of ammunition types may be used and carrying multiple firearms is impractical, undesirable or impossible. Typically, the sighting device is used on shotguns or other smoothbore firearms. However, the sighting device may be used whenever variable ammunition are used.

Figure 1:
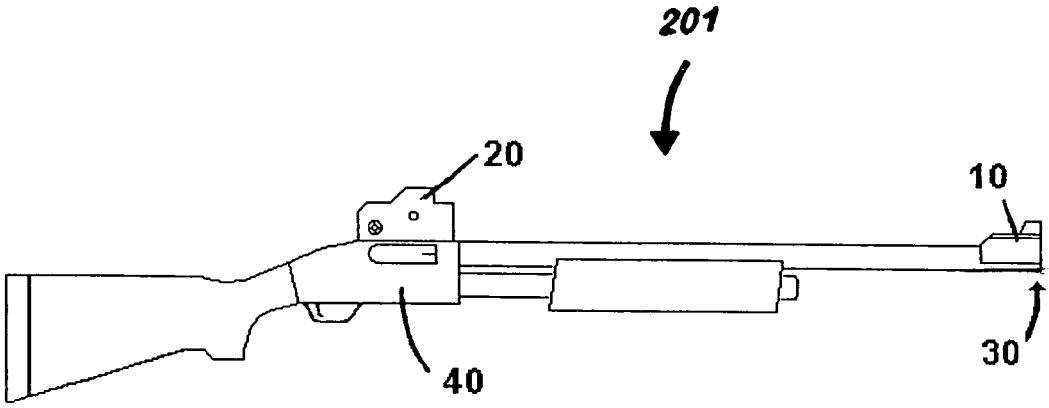
FIG. 1 is a side view of one embodiment of the invented adjustable sighting system mounted atop a firearm demonstrating the preferred placement of front and rear sight components.

The sighting device preferably comprises adjustable front 10 and rear 20 sights. As shown in FIG. 1, the front and rear sights are generally secured to the upper surface of the shotgun muzzle 30 and action 40, respectively. The front sight 10 may be a blade sight such as those typically used on rifles. Preferably, the rear sighting apparatus 20 includes both a hollow ring 50 and a V-shaped notch 60 through which the front sight may be viewed. These elements may be easily interchanged as the demands of the shooting situation change. Typically, the front sight is viewed through the hollow ring to align shots taken with buckshot-type ammunition and the V-shaped notch is used to align shots taken with slug loads.

Figure 2B:
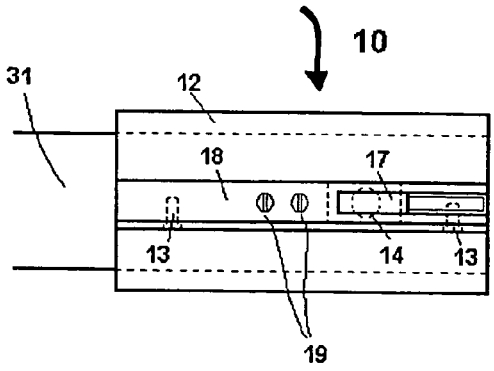
FIG. 2B is a top view of the front sight of FIG. 2A seated atop a firearm barrel.
Figure 2A:
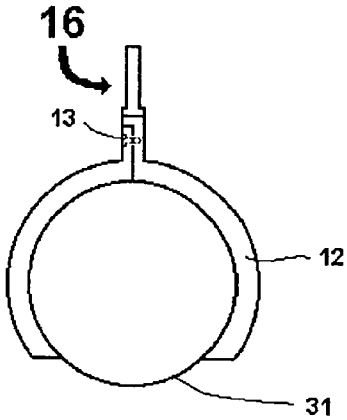
FIG. 2A is an end cross-sectional view of one embodiment of the front sight base with blade attached showing cooperation between the firearm muzzle and sight base.
Figure 2C:
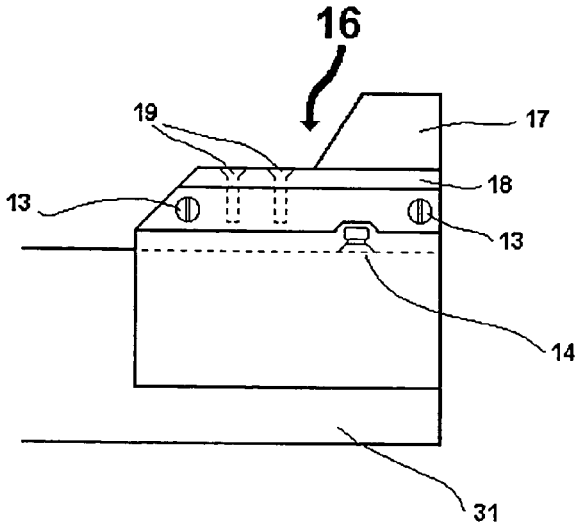
FIG. 2C is a side view of the front sight of FIGS. 2A and 2B situated above the firearm muzzle.

The front sight 10 is secured to the muzzle 30 of the shotgun barrel 31 via a sight base 12, as shown in FIG. 2A. The sight base 12 preferably comprises two substantially semi-circular pieces which conform to the exterior dimensions of the shotgun barrel 31. The pieces of the sight base may be joined with screws 13, or other fasteners, to clasp the muzzle 30, as shown in FIG. 2B. In some situations, it may be necessary to include a space between the pieces, or a cavity, which accommodates a conventional bead sight 14 beneath the base 12, as shown in FIG. 2C. The pieces of the sight base 12 may be constructed of steel, steel alloys, or other suitably rigid materials. Preferably, frictional engagement of the shotgun barrel 31 or bead sight 14 prevents axial movement of the sight base along the length of the barrel. However, other means of securing the sight base may be employed such as, for example, adhesive, as long as the bore's interior is not disturbed.

Figure 3A:
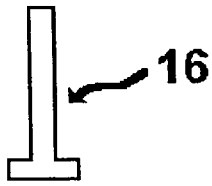
FIG. 3A is an end view of the front sight blade of FIGS. 2A–2C.
Figure 3B:
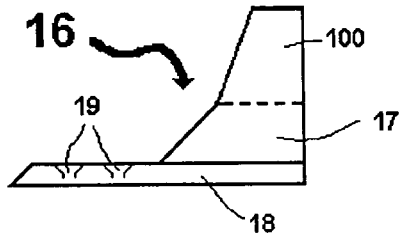
FIG. 3B is a side view of the front sight blade of FIGS. 2A–2C with negative minute fin attached.
Figure 3C:
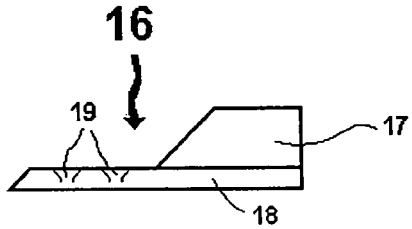
FIG. 3C is a side view of the front sight blade of FIGS. 2A–2C and 3A without a negative minute fin attached.

In the lesser preferred embodiment, the uppermost surface of the sight base 12 is generally flat to accommodate the blade 16. The blade may comprise a fin 17, which is fixedly secured to a mount 18. The mount is generally flat. The fin 17 may be joined to the mount 18 via welding, or the fin and mount may be manufactured as an integral unit. The cross section of the blade as viewed from the shotgun muzzle 30 may be generally in the shape of an inverted "T" with the fin extending vertically above its mount, as shown in FIG. 3A. The blade 16, specifically the mount 18 in the preferred embodiment, may be secured to the flat upper surface of the sight base with screws or other fasteners. FIGS. 3 and 2C illustrate the preferred mechanism for joining the blade 16 to the sight base 12.

In some situations, a larger blade may be necessary to properly calibrate the sighting system. A detachable negative minute fin 100 may be provided to increase the height of the blade 16 when necessary, as shown in FIG. 3B. The negative minute fin 100 may attach to the lower fin 17 in a number of ways. For example, the negative minute fin 100 may be screwed or snapped onto the lower fin 17, or the lower fin 17 may include a small orifice for receiving, and frictionally engaging, a small pin extending from the base of the negative minute fin. Thus, the overall height of the front sight 10 may be adjusted to the demands of the circumstances as long as the front sight 10 may be viewed through the rear sight 20 to suggest an appropriate sighting plane.

Figure 4A:
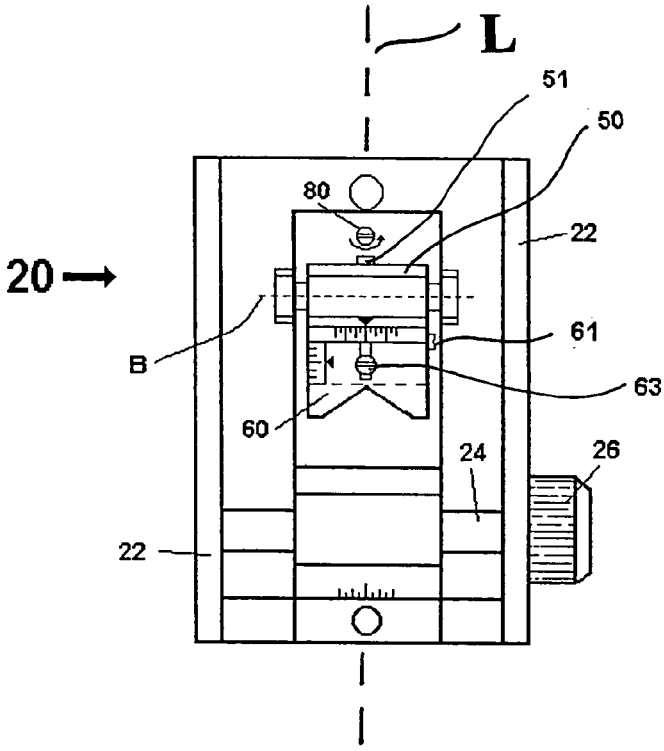
FIG. 4A presents a top view of one embodiment of the invented rear sight apparatus with ghost ring in position.
Figure 4B:
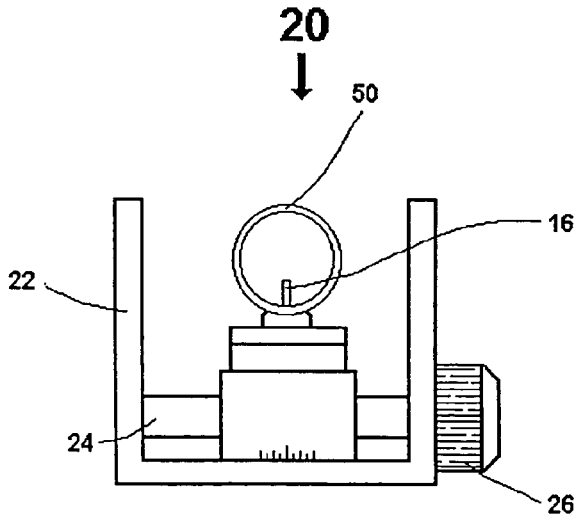
FIG. 4B presents an end view of the embodiment of FIG. 4A.

The rear sight 20 comprises two independent sighting elements which may be interchanged to facilitate alignment of either buckshot or slug-type ammunition. The functioning components of the rear sight 20 are preferably contained within a housing 22, as shown in FIGS. 4A and 4B. The housing 22 protects the moving parts of the sighting device and may also help to channel the shooter's vision in the proper direction. The rear sight housing 22 is preferably mounted to the firearm 201 above the action 40 with screws or other fasteners, as shown in FIG. 1. The positioning of the rear sight 20 relative to the centerline of the action 40 may be adjustable to facilitate windage calibrations. In the preferred embodiment, a generally cylindrical, rotatable shaft 24 extends between opposing walls of the housing 22. In this embodiment, the shaft 24 operates like a worm gear to move the internal components of the rear sight apparatus in a direction generally perpendicular to the barrel 31 of the firearm 201 for windage adjustment. The shaft 24 is preferably rotated manually by turning a dial 26, such as the one shown in FIGS. 4A and 4B, which is operably connected to the shaft 24 external to the rear sight housing 22. Adjusting the dial 26 rotates the threaded shaft 24, which moves both sight components together, transversely to the sight 20 longitudinal axis L. This serves to adjust windage for the ring sight 50. To provide separate windage adjustment for the notch sight 60, a separate (additional) windage adjustment 61 is provided that moves sight 60 transversely relative to sight 50.

Figure 5A:
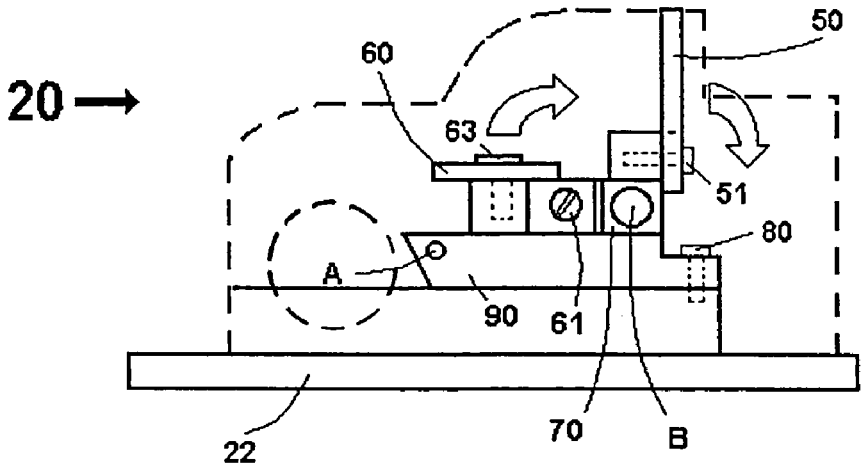
FIG. 5A presents a side view of the rear sight apparatus of FIGS. 4A and 4B showing the internal, working components and showing the housing side wall in dashed lines.
Figure 5B:
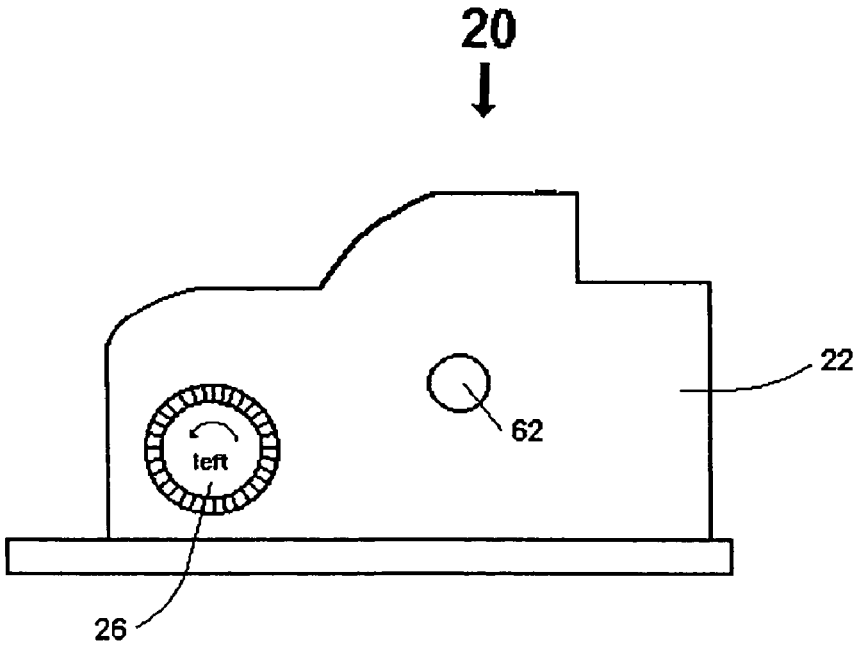
FIG. 5B presents a side view of the rear sight apparatus of FIGS. 4A, 4B, and 5B showing the external appearance of the housing side wall.
Figure 6A:
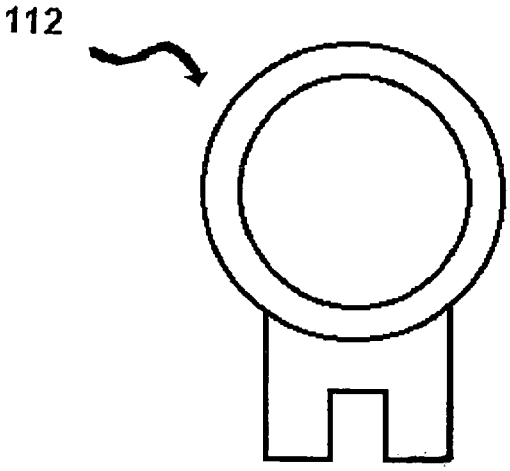
FIGS. 6A–D shows several interchangeable stencils of various heights for the hollow ghost ring and V-shaped notch of the rear sighting apparatus of FIGS. 4–5.
Figure 6B:
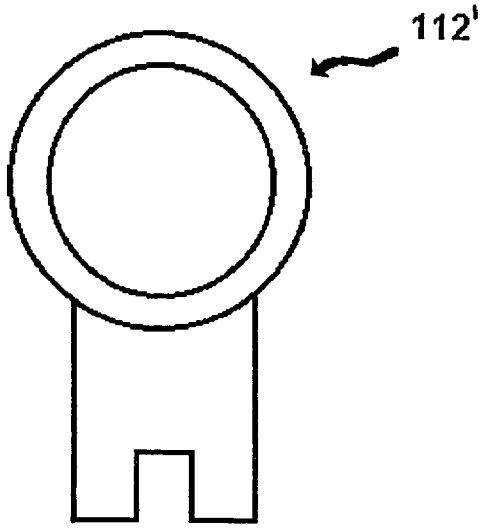
Figure 6C:
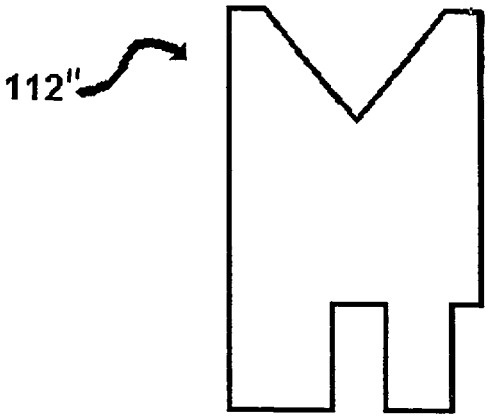
Figure 6D:
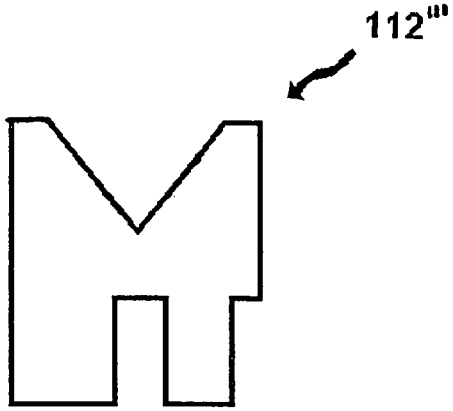

Additional adjustability features may be built into the rear sight apparatus. In the embodiment of FIGS. 4–5, an important feature comprises a mechanism for alternating between the hollow "ghost" ring 50 used for buckshot-type ammunition and the V-shaped notch 60 used with slug-type loads. While the inventor envisions that flipping, sliding, rotating or other such mechanisms may be used to interchange the different sighting elements, the embodiment of FIGS. 4–5 features the V-shaped notch 60 and the ghost ring 50 attached to a pivoting "L" shaped mount 70. The "L" shaped mount of the preferred embodiment pivots about its elbow at approximately point B. In this arrangement, the separate elements form a single pivoting unit and are separated by generally a right angle, as illustrated in FIG. 5. Consequently, flipping the V-shaped notch 60 into the line of sight pivots the ghost ring 50 out of the sight plane and vice versa, as illustrated in FIG. 5. Applying slight pressure to the pivoting system flips the sights. Releasable clasps, or other mechanisms, may be desirable to fix the sights in a given position. Alternatively, rotating dials or gears may pivot the sighting elements to minimize contact with delicate or sensitive components of the rear sight 20.

When the desired sighting element is positioned within the sight plane, windage and elevation calibrations may be accomplished by adjusting the appropriate components. As mentioned above, windage adjustments may be made for the V-shaped rifle sight 60 by turning the windage screw 61 of FIG. 5 clockwise or counterclockwise. Adjustments are preferably made using a screwdriver reaching through an access hole 62 in the sight housing, such as the one shown in FIG. 5. Preferably, such adjustments are made on a target range where accurate calibrations may be made. In addition, these adjustments are preferably made a single time, prior to engaging in shooting activities requiring variable ammunition.

In the lesser preferred embodiment, gross adjustment of both rear sighting arrangements (i.e. ghost ring 50 and notch 60) may be accomplished by tightening or loosening the spring-loaded screw 80 of FIG. 5. The internal components of the rear sighting system are preferably situated atop an elevated sight base 90. Preferably, the elevated sight base 90 pivots around point A and may, therefore, be raised or lowered by adjusting the spring-loaded screw 80. Preferably, the sighting system includes a plurality of variable-height stencils 112 (see 112, 112', 112", and 112'" in FIGS. 6*a*–6*d*). Fine adjustment of the individual rear sighting components may be accomplished by adjusting the height of the stencils 112. The ghost ring 50 and notch 60 stencils may be adjusted by loosening setscrews 51 or 63, respectively, rasing or lowering the stencils 112, and then retightening the setscrews 51 or 63. Alternatively, the stencils 112 may be removed and replaced with stencils 112 of other dimensions.

Adjustment or interchanging of the stencils 112 may be necessary to compensate for windage and/or elevation calibrations made elsewhere within the rear sighting system. For example, the height of a notched stencil 112 may be made to return the V-shaped notch 60 to proper alignment after raising the overall height of the sight base 90 to calibrate the ghost ring 50.

FIGS. 7–17

Figure 7:
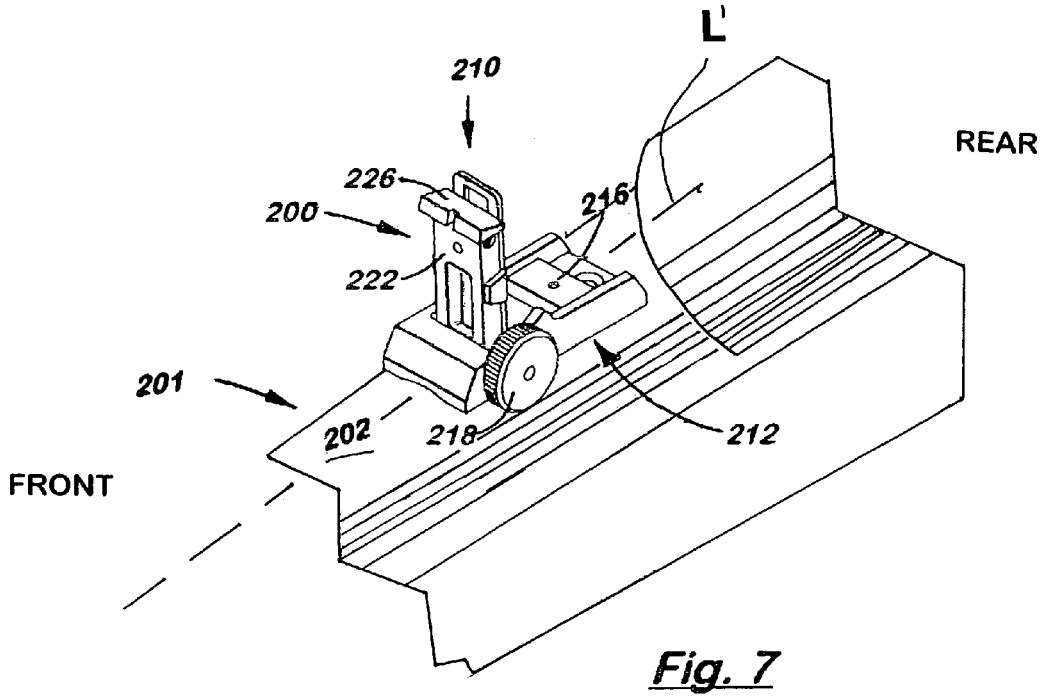
FIG. 7 is a front perspective view of the especially preferred rear sighting unit mounted atop a firearm, with the label "front" toward the front end of the firearm.
Figure 8:
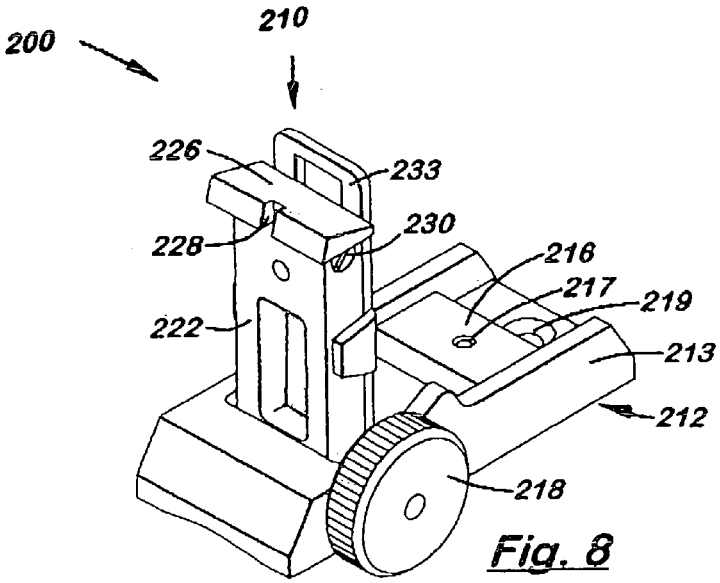
FIG. 8 is a front perspective view of the especially preferred rear sighting unit of FIG. 7.
Figure 9:
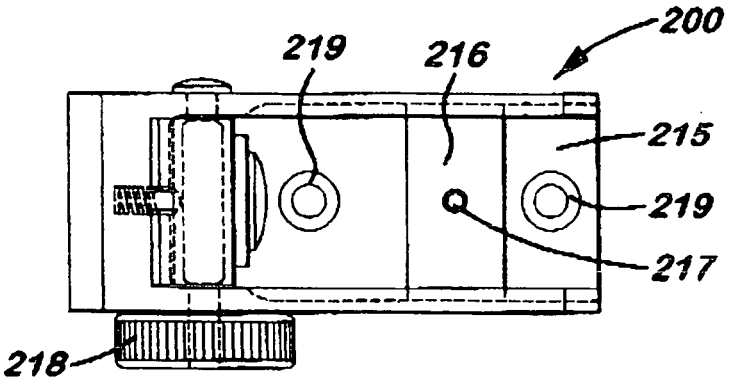
FIG. 9 is a top view of the especially preferred rear sighting unit of FIGS. 7 and 8.
Figure 10:
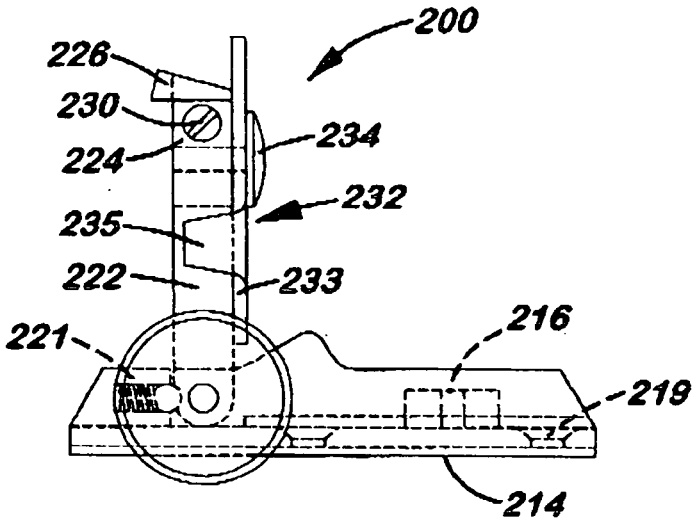
FIG. 10 is a left side view of the especially preferred rear sighting unit of FIGS. 7–9.
Figure 11:
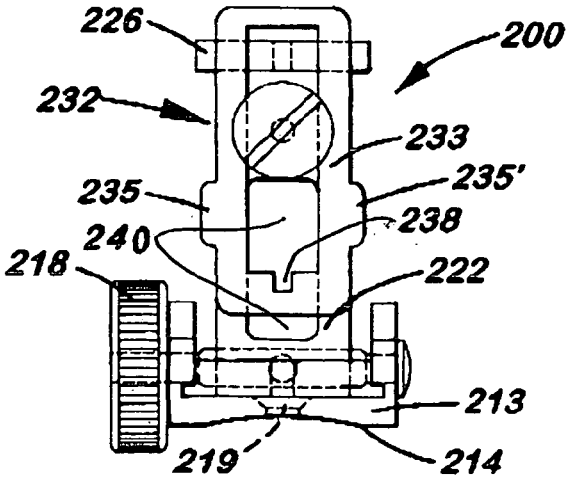
FIG. 11 is a rear view of the especially preferred rear sighting unit.

The especially preferred rear sight unit 200, shown in FIGS. 7–17, may be used in combination with the front sight 10 of FIGS. 1–3, or with other front sights. The rear sight unit 200 comprises a rear sight pivotal assembly 210 and a rear sight base assembly 212 (see FIG. 8). The bottom surface of the rear sight base assembly 214 is preferably mounted to the top surface 202 of the firearm 201 with screws or other fasteners through holes 219 in the rear sight base assembly 212, as shown in FIGS. 7 and 8. The rear sight unit 200 is typically positioned with its longitudinal axis L parallel with the longitudinal axis L' of the firearm 201. The rear sight pivotal assembly 210 is attached to the rear sight base assembly 212 at a pivot axle 220, as shown in FIG. 9. In the preferred embodiment, the pivot axle 220 is a generally cylindrical, rotatable shaft that extends between opposing walls of the rear sight base assembly 212. In this embodiment, the pivot axle 220 is threadably engaged with a female surface of the rear sight pivotal assembly 210 (see FIG. 11). Preferably, the pivot axle 220 is rotated manually by turning a knob 218 that is operably connected to the pivot axle 220 on an external side of the rear sight base assembly 212, as shown in FIGS. 8 and 11. As the pivot axle 220 rotates, the rear sight pivot assembly 210 moves transversely in relation to the longitudinal axis L' of the firearm 201, which allows for windage adjustment of the rear sight pivot assembly 210.

The rear sight pivotal assembly 210 comprises a pivot arm 222, a close range sight assembly 231, and a long range sight assembly 232. The pivot arm 222 pivots on axle 220 and pivots between angles generally perpendicular to the firearm's longitudinal axis L' and generally parallel to the firearm's longitudinal axis L'. When the pivot arm 222 is in a perpendicular position, the long range sight assembly 232 is in optimum position for sighting-in long range ammunition, such as a slug cartridge. As the pivot arm 222 is moved to angles more parallel to the firearm's longitudinal axis L', the close range sight assembly 231 is in optimum position for sighting-in short range ammunition, such as a buckshot cartridge. A detent system 221 frictionally engages the rear side of the pivot arm 222 to limit the pivot arm's 222 rotation and/or to latch the arm 222 in the generally vertical position; other latches or locks may be used.

The close range sight assembly 231 may be attached to the front side of the pivot arm 222 either as an integral part of the pivot arm, as shown in FIG. 8, or with the close range sight assembly 231 attached to the pivot arm 222 by a screw or other fastener. The long range sight assembly 232 may be attached to the rear side of the pivot arm 222 with a screw 234, as shown in FIG. 11, or with other fastening mechanisms that allow for height adjustment of the long range sight assembly 232.

Figure 12:
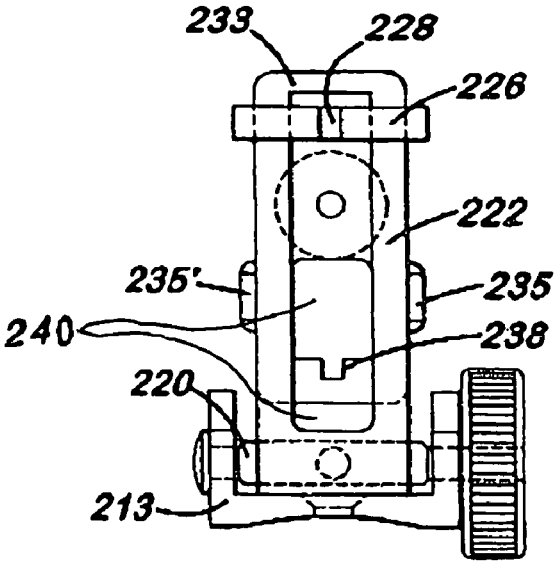
FIG. 12 is a front view of the especially preferred rear sighting unit, with the long range sight assembly at a low position.
Figure 13:
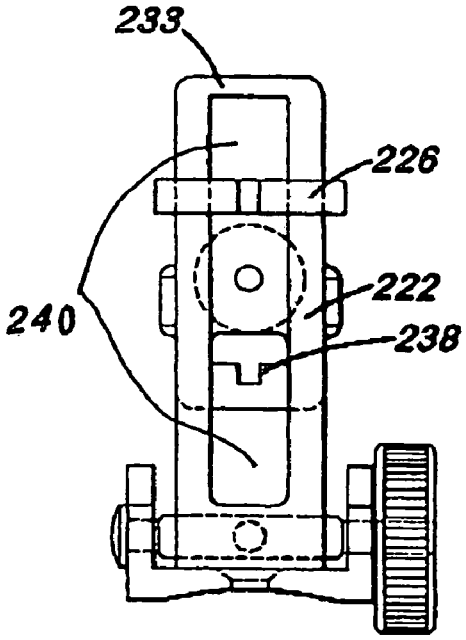
FIG. 13 is a front view of the especially preferred rear sighting unit, with the long range sight assembly at a high position.
Figure 14:
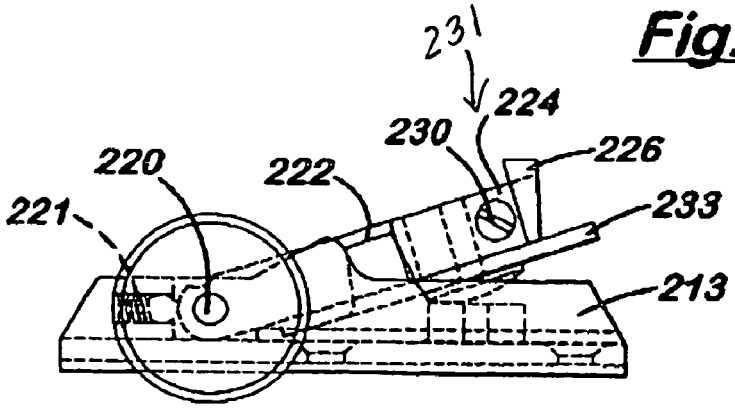
FIG. 14 is a left side view of the especially preferred rear sighting unit, when the pivotal assembly is flipped to place the close range sight assembly in operable position.
Figure 15:
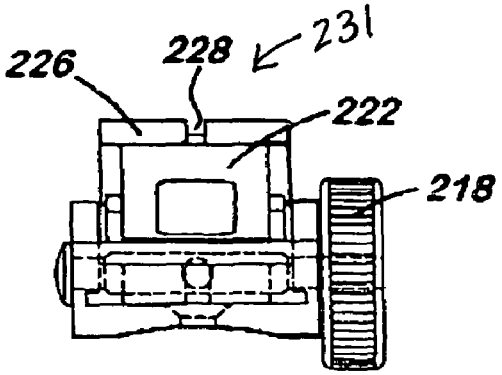
FIG. 15 is a front view of the especially preferred rear sighting unit, when the close range sight assembly is in the operable position.
Figure 16:
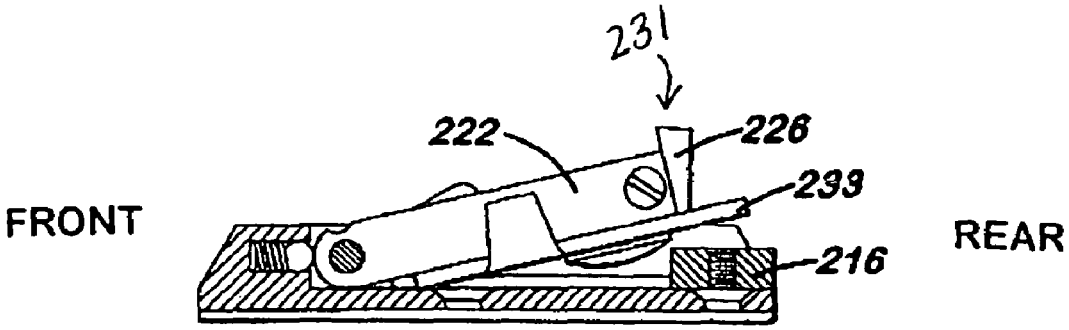
FIG. 16 is a cross-sectional, left side view of the especially preferred rear sighting unit, when the pivotal assembly is flipped to place the close range sight assembly in its lowest operable position and the sliding member is at its farthest rear position along the rear sight base unit.
Figure 17:
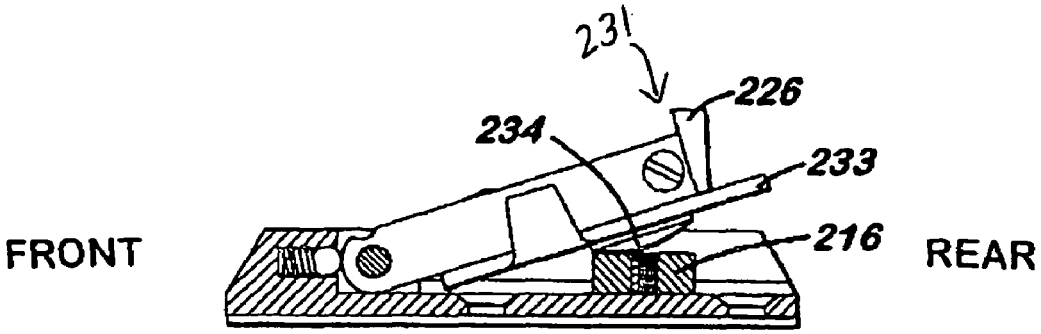
FIG. 17 is a cross-sectional, left side view of the especially preferred rear sighting unit, when the close range sight assembly is raised in elevation due to the sliding member being at a middle position along the rear sight base unit.

The long range sight assembly 232 preferably includes a long range elevation adjustment frame 233, a screw 234 for locking and releasing the frame 233 in a desired position, a left flap 235 of the long range elevation adjustment frame 233, a right flap 235' of the long range elevation adjustment frame 233, and a long range sight notch 238 (see FIG. 11). Preferably, when the pivot arm 222 is in a position perpendicular to the longitudinal axis L' of the firearm 201, the long range sight assembly 232 is fully visible to the user for lining up the notch 238 with the front sight 10. The windage is adjusted for the long range sight assembly 232, by manually turning the knob 218, which moves the pivot arm 222 transversely, in turn moving the long range sight assembly 232 transversely. The long range elevation adjustment frame 233 is secured in a position on the front side of the pivot arm 222 with a screw 234. In this embodiment, the long range sight notch 238 is located at the bottom of the frame 233, as shown in FIG. 11. To adjust the elevation of the long range sight notch 238, the firearm 201 user unscrews the screw 234 and raises or lowers the frame 233 depending on the desired elevation, as shown in FIGS. 12 and 13. In this embodiment, the left 235 and right 235' flaps of the frame prevent the frame from tilting when the screw 234 is loosened (see FIG. 11). The user secures the frame 233 and notch 238 at the desired elevation by tightening the screw 234, and then is able to aim the firearm 201 by looking through the long range sight notch 238. Preferably, once the elevation and windage of the long range sight assembly 232 have been adjusted, the user can adjust the windage and elevation for the close range sight assembly 231.

The close range sight assembly 231 preferably includes a housing for close range windage adjustment 224, a close range sight member 226, a close range sight notch 228, and a close range windage adjustment 230 (see FIGS. 8 and 10). Preferably, the close range windage adjustment 230 is located in the housing 224, and may be a threaded rotatable shaft that threadably engages the close range sight member 226. As the close range windage adjustment 230 is rotated, the close range sight member 226 moves transversely in relation to the pivot arm 222 and, hence, the firearm 201 longitudinal axis L', in turn moving the close range sight notch 228. The transverse movement of the close range sight member 226 and notch 228, permits the firearm 201 user to adjust the windage of the close range sight 231.

In order to adjust the elevation of the close range sight assembly 231, the firearm 201 user pivots the pivot arm 222 to a desired angle more parallel to the firearm 201 longitudinal axis L'. The pivot arm 222 is secured at the desired angle by resistance from the detent system 221 and with a sliding elevation adjustment member 216 that the user moves longitudinally along the top surface of the rear sight base assembly 215, so it abuts against the long range sight assembly 232 at various locations depending on the desired elevation, as shown in FIGS. 14–17. The sliding elevation adjustment member 216 is held in the desired position along the top surface of the rear sight base assembly 215 with a set screw 217 (see FIG. 9). The edges of the channel in which the member 216 slides may overhang the member 216 to retain the member 216 from falling out of the base 213. Once the close range elevation and windage have been adjusted, the user can aim the firearm 201 by looking through the close range sight notch 228.

An alternative apparatus my be used to adjust the acute angle of the pivot assembly 210 to the base assembly 212. For example, instead of the sliding member 216 "holding up" the pivot assembly 210, a different latch, lock, or wedge member may adjust or secure the assembly 210 at any location within a desired continuous range of acute angles, or at incremental locations within a desired non-continuous range of acute angles. Typically, the pivotal assembly 210 will be (for long range) either in a generally vertical position (preferably vertical ±20 degrees) or (for close range) at various angles in the range of about 0–25 degrees from the firearm 201 longitudinal axis L'.

While notches 228 and 238 are illustrated as rectangles, other shapes and styles of sight surfaces may be used, for example, peeps, rings, or V-shaped notches. Further, frame 233 may be redesigned to be a different shape and have a different attachment or elevation system. For example, a U-shaped frame with a notch or simply a bar with a notch may be used with a screw, screws, pins, ratchets, clips, latches/locks, or other fasteners adjustably connecting the frame or bar to a surface of the pivot arm 222, preferably not blocking the aperture 240. Using a U-shaped frame, bar, or other sight member of smaller/shorter dimensions than the illustrated frame 233, and/or using adjustment mechanisms other than the screw 234, may reduce obstruction of the aperture 240. Aperture 240 is one embodiment of an opening/hole through the pivot arm 222, which serves as a "window" through the arm 222. This aperture/window allows the user to see through the arm, so that he/she may see both the notch 238 and the front sight 10 at the same time and align them, during both sighting-in of the firearm and aiming for shooting with the chosen ammunition.

In use, the firearm 201 user will sight-in the firearm 201 using a first-type ammunition, for example, slug-type cartridges. He/she may begin with the basic form of the front sight 10 (without extension fin 100). If this front sight configuration does not allow the user to sight-in ("zero") the firearm properly by adjusting elevation and windage of the rear sight unit 200, then the front sight 10 may be extended upwards to make an incremental, gross adjustment in the position of the front end of the firearm 201 (for example, lowering of the front end when the front sight is raised, for a given rear sight unit configuration). Then, with the front end of the firearm grossly adjusted by the extended front sight unit, the new grossly-adjusted position of the firearm will typically be such that rear sight unit 200 can be adjusted for elevation and windage to give the desired zeroing results. Typically, for many slug applications, the front sight unit will be extended and the pivot arm 222 in the vertical position.

To sight-in the second "zero", ammunition may then be switched, and the rear sight pivotal assembly 210 may be pivoted to the proper angle relative to the base assembly 212, controlled by the sliding member 216 and determined by trial and error. Windage is also adjusted via adjustment 230. The front sight 10 may also be adjusted or switched-out to another fin 17 if needed for the second ammunition.

The result is a dual-zero sight system, with two zeroing systems for two types of ammunition. While the system may be used for different ranges and a single ammunition, the specials features are especially effective for the very different trajectories that different ammunition can exhibit.

Other adjustment mechanisms are envisioned for the elevation and windage adjustments. For example, see earlier comments on alternative mechanisms for locking/latching the pivot arm at various angles for elevation adjustment. Further, while it is preferred that the sight member 226 does not slide longitudinally along the pivot arm, some embodiments may include such an elevation adjustment for sight member 226 instead of, or in addition to, the elevation adjustment provided by the pivoting arm. Other mechanisms may move/secure the second sight member (frame 233) up and down on the pivotal frame, for example, as in the above comments regarding embodiments of U-shaped frames and/or bars. For windage adjustment, other mechanisms besides the worm-style, threaded adjustments (220/218 and 230) may move the sight member 226 transversely to the pivot arm and the pivot arm 222 transversely to the base assembly 212: for example, a ratchet mechanism, a slide and lock mechanism, a slide mechanism wherein the user unlocks the sight member 226 and slides the member 226 to align with pre-marked calibration indicia and re-locks the member 226, or others.

The preferred sighting units are operated manually, without power sources other than the user of the device, and without a motor or electronics. The user may grasp various parts of the sighting unit to affect the switch between sighting elements, as long as the parts or provided handles/grips are sturdy enough to prevent damage from normal operation. The interchanging of sight elements may be done by manually rotating, flipping, or sliding the desired sight element into the operable/usable position, which, due to the linkage/connection between the elements, moves the unnecessary element out of the sight path. Alternatively, the interchanging may be done by manually moving the unnecessary element out of the way, which, due to the linkage/connection, moves the desired element into the operable/usable position.

While the terms "long range" and "close range" are used in the Detailed Description to describe first and second sight members installed on the pivot arm of the preferred embodiment, these terms are not necessarily intended to limit those sight members or the operation of the invented device to long range shooting with the pivot arm in the upright, generally vertical position, or to close range shooting with the pivot arm in a lowered/generally-horizontal position. Depending upon the characteristics of the ammunition being selected and the desired application/range, the two sight or zero systems on the rear sight unit may be used differently and/or for different ranges. After viewing the Figures and the Description, one may see that the general principles of the invention may be applied with other shapes, positions, movements, and operations for the multiple sights, while still being within the scope of the invention. For example, one may see that many embodiments of the rear sight unit may be rotated 180 degrees on the firearm so that the pivot arm pivots down toward the front end of the barrel, rather than pivoting down toward the butt of the gun. Some changes in shape and/or dimensions of the pieces-parts of the device might then be needed, for example, to account for the slightly nearer location of the sights to the user's eye, but many or all issues related to the orientation on the firearm may be accommodated during the sighting-in process and/or by modifications in the front sight unit 10. Therefore, the terms "front" and "rear" of the sighting device are used for clarity in describing the especially-preferred embodiment of the invention, but are not necessarily intended to limit the invention to the particulars disclosed in the Drawings and Detailed Description.

Although this invention has been described above with reference to particular means, materials and embodiments, it is to be understood that the invention is not limited to these disclosed particulars, but extends instead to all equivalents within the scope of the following claims.

I claim:

1. A firearm sighting device comprising:

a base for attachment to a firearm;

a plurality of sight members movably connected to the base so that any one selected sight member of said plurality of sight members is moveable into operable position in a line of sight for aiming the firearm and the other of said plurality of sight members are movable away from operable position to be out of the line of sight;

separate elevation adjustment mechanisms for each of said plurality of sight members; and separate windage adjustment mechanisms for each of said plurality of sight members.

2. A firearm sighting device as in claim 1, wherein said plurality of sight members are attached to a single pivotal arm that pivots to a generally upright position and pivots down toward the base to a lowered position, wherein one of said plurality of sight members is the selected sight member positioned to be operable for aiming when the pivotal arm is in the upright position, and wherein a different one of said plurality of sight members is the selected sight member positioned to be operable for aiming when the pivotal arm is in the lowered position.

3. A firearm sighting device as in claim 1, wherein said plurality of sight members are positioned on an L-shaped pivotal frame having a first leg and a second leg, one of said plurality of sight members being on said first leg and another of said plurality of sight members being on said second leg.

4. A firearm sighting device as in claim 2, wherein there are two sight members comprising a first sight member attached to a front side of the pivotal arm and a second sight member on a rear side of the pivotal arm.

5. A firearm sighting device as in claim 4, wherein said separate elevation adjustment mechanism for the first sight member comprises the first sight member being slidable longitudinally along the pivotal arm and lockable in multiple positions on the pivotal arm.

6. A firearm sighting device as in claim 4, wherein the pivotal arm is at an acute angle relative to the base when the pivotal arm is in the lowered position, and said separate elevation adjustment mechanism for the second sight member comprises a locking mechanism.

7. A firearm sighting device as in claim 6, wherein said locking mechanism is a sliding member that slides longitudinally on said base to have different longitudinal positions on the base, each of said longitudinal positions on the base holds up the pivotal arm at a different acute angle.

8. A firearm sighting device as in claim 4, wherein said separate windage adjustment mechanism for said first sight member comprises a threaded shaft.

9. A firearm sighting device as in claim 4, wherein said separate windage adjustment mechanism for said second sight member comprises a threaded shaft.

10. A firearm sighting system comprising a front sight unit adapted to be attached to a front end of a firearm and a rear sight unit, the rear sight unit comprising:

a base for attachment to a firearm;

a plurality of sight members movably connected to the base so that any one selected sight member of said plurality of sight members is moveable into operable position in a line of sight for aiming the firearm and the other of said plurality of sight members are movable away from operable position to be out of the line of sight;

separate elevation adjustment mechanisms for each of said plurality of sight members; and separate windage adjustment mechanisms for each of said plurality of sight members; and the front sight unit comprising a front sight base for attachment to a firearm barrel and a fin upending from the front sight base wherein said fin is extendible to lengthen the fin to elevate the fin above a distal end of the barrel.

11. A firearm sighting system as in claim 10, wherein said fin is extendible by an extension member attachable to the fin.

12. A firearm sighting device as in claim 10, wherein said plurality of sight members are attached to a single pivotal arm that pivots to a generally upright position and pivots down toward the base to a lowered position, wherein one of said plurality of sight members is the selected sight member positioned to be operable for aiming when the pivotal arm is in the upright position, and wherein a different one of said plurality of sight members is the selected sight member positioned to be operable for aiming when the pivotal arm is in the lowered position.

13. A firearm sighting device as in claim 10, wherein said plurality of sight members are positioned on an L-shaped pivotal frame having a first leg and a second leg, one of said plurality of sight members being on said first leg and another of said plurality of sight members being on said second leg.

14. A firearm sighting device as in claim 11, wherein there are two sight members comprising a first sight member attached to a front side of the pivotal arm and a second sight member on a rear side of the pivotal arm.

15. A firearm sighting device as in claim 14, wherein said separate elevation adjustment mechanism for the first sight member comprises the first sight member being slidable longitudinally along the pivotal arm and lockable in multiple positions on the pivotal arm.

16. A firearm sighting device as in claim 14, wherein the pivotal arm is at an acute angle relative to the base when the pivotal arm is in the lowered position, and said separate elevation adjustment mechanism for the second sight member comprises a locking mechanism.

17. A firearm sighting device as in claim 16, wherein said locking mechanism is a sliding member that slides longitudinally on said base to have different longitudinal positions on the base, each of said longitudinal positions on the base holds up the pivotal arm at a different acute angle.

18. A firearm sighting device as in claim 14, wherein said separate windage adjustment mechanism for said first sight member comprises a threaded shaft.

19. A firearm sighting device as in claim 14, wherein said separate windage adjustment mechanism for said second sight member comprises a threaded shaft.

* * * * *